US007516635B2

(12) United States Patent
Massee

(10) Patent No.: US 7,516,635 B2
(45) Date of Patent: Apr. 14, 2009

(54) METHOD AND FORMING MACHINE FOR DEFORMING A WORKPIECE

(76) Inventor: Johan Massee, Vijfsprongweg 104, NL-6741 JC Lunteren (NL)

( * ) Notice: Subject to any disclaimer, the term of this patent is extended or adjusted under 35 U.S.C. 154(b) by 19 days.

(21) Appl. No.: 10/577,972

(22) PCT Filed: Nov. 4, 2004

(86) PCT No.: PCT/NL2004/000776

§ 371 (c)(1),
(2), (4) Date: Dec. 22, 2006

(87) PCT Pub. No.: WO2005/042180

PCT Pub. Date: May 12, 2005

(65) Prior Publication Data

US 2007/0101788 A1 May 10, 2007

(30) Foreign Application Priority Data

Nov. 4, 2003 (NL) ..... 1024697

(51) Int. Cl.
*B21D 22/14* (2006.01)

(52) U.S. Cl. ..... 72/82; 72/8.3; 72/8.8

(58) Field of Classification Search ..... 72/8.3, 72/8.8, 11.1, 11.5, 82, 83, 84, 85, 120, 121
See application file for complete search history.

(56) References Cited

U.S. PATENT DOCUMENTS 5,598,729 A * 2/1997 Hoffmann et al. ..... 72/8.5
6,212,926 B1 * 4/2001 Jenness ..... 72/69
6,817,219 B2 * 11/2004 Pollkoetter ..... 72/85

FOREIGN PATENT DOCUMENTS

JP 58003729 1/1983
WO WO 02/053307 7/2002

OTHER PUBLICATIONS

Official International Search Report of the European Patent Office in counterpart application No. PCT/NL2004/000776 filed Nov. 4, 2004.
Patent abstracts of Japan, vol. 0070, No. 74 (M-203) , Mar. 26, 1983.
International Preliminary Report on Patentability in counterpart application No. PCT/NL2004/000776 filed Nov. 4, 2004.

* cited by examiner

*Primary Examiner*—Edward Tolan
(74) *Attorney, Agent, or Firm*—Steven M. Koehler; Westman, Champlin & Kelly, P.A.

(57) ABSTRACT

The invention relates to a method and a forming machine for deforming a workpiece, such as a metal cylinder or plate (3), by means of a tool, in particular one or more forming rollers (5), wherein the workpiece and/or the tool are rotated about an axis (4) relative to each other, the tool move; through one or more deforming curves and at least part of the workpiece is deformed. During the deforming process, values of one or more coordinates of the position of the extreme: edge of the workpiece are measured, and one or more parameters of the deforming process is/are changed on the basis of the measured values.

9 Claims, 7 Drawing Sheets

METHOD AND FORMING MACHINE FOR DEFORMING A WORKPIECE

CROSS-REFERENCE TO RELATED APPLICATION

The present application is a National Stage filing of and claims priority of International patent application Ser. No. PCT/NL2004/000776, filed Nov. 4, 2004, and published in English.

BACKGROUND OF THE INVENTION

The invention relates to a method for deforming a workpiece, such as a metal cylinder or plate, by means of a tool, in particular one or more forming rollers, wherein the workpiece and/or the tool are rotated about an axis relative to each other, the tool moves through one or more deforming curves and at least part of the workpiece is deformed. The invention furthermore relates to a forming machine for deforming a workpiece, which forming machine comprises a control unit.

Such a method and forming machine are known from European patent application No. 0 125 720. Said publication describes a forming machine comprising a control unit for controlling the movement of the forming roller. The control unit is connected to a detector for measuring the force exerted on the forming roller (by the workpiece) and to a detector for determining the position of the forming roller, whilst a memory is connected to the control unit for storing associated force/position values, and the control unit is adapted for controlling the movement of the forming roller in dependence on the force/position values that are stored in said memory.

Another example is described in WO 02/07907. Said publication relates to a method and a forming machine for deforming a hollow workpiece having at least one open end, wherein a first forming tool is placed into contact with the outer side of the workpiece and a second forming tool is placed in the cavity defined by the workpiece, into contact with the inner side of the workpiece, and the workpiece is deformed by means of tools.

In many cases, the length of the deformed portion of semi-manufactured products obtained by means of this type of methods and forming machines will be different from the length that is required or desirable in connection with further operations to which the semi-manufactured product is to be subjected. To obtain the required or desired length, an additional operation must be carried out in that case, for example cutting the edge (or edges) of said semi-manufactured products to size.

SUMMARY OF THE DESCRIPTION

One aspect of the invention is to improve the method and the forming machine described in the introductory paragraph.

To that end, the method is characterized in that values of one or more coordinates, for example a coordinate along the aforesaid axis of rotation, of the position of the extreme edge of the workpiece are measured during the deforming process, and that one or more parameters of the deforming process is/are changed on the basis of the measured values.

During the deforming process, the workpiece will be plastically elongated (in the direction of the edge) to a greater or lesser extent. The extent of the elongation depends on the thickness and the hardness of the workpiece, among other things. Local differences in the thickness or the hardness may have an unpredictable effect on said elongation. Thus, a locally increased hardness may result in a reduced elongation.

The length of the deformed portion of the workpiece can be corrected by measuring the position of the edge during the deforming process and adapting the feeding rate, i.e. the speed with which the tool moves along the workpiece, the rotational speed with which the tool and the workpiece are rotated relative to each other, and/or the position of the deforming curves being passed through during the deforming process, on the basis of said measurement. Although these three parameters are preferred, it is also possible to adapt the shape of the deforming curves over their entire length, or at least such that no locally reduced portions will be imposed on the deformed portion.

By using a lower feeding rate and/or a higher rotational speed and/or by shifting the position of one or more of the deforming curves in the direction of the axis of rotation and/or by changing the shape of said curves, for example gradually making them more concave, the elongation can be increased, and vice versa. By using a higher feeding rate and/or a lower rotational speed and/or by shifting the position of one or more of the deforming curves in a direction away from the axis of rotation and/or by changing the shape of said curves, for example gradually making them more convex, the elongation can be decreased.

Preferably, the values of one or more coordinates of the position of the extreme edge of the workpiece are measured at least at the end of each pass, more preferably during the entire deforming process. Thus, the deforming process can be adjusted continuously, without complicated calculations being required, and the intended length can be achieved quickly, i.e. preferably without additional deforming curves or other operations.

The invention furthermore relates to a forming machine for deforming a workpiece, such as a metal cylinder or plate, comprising a tool, in particular a forming roller, one or more driving means for moving said tool, a control unit comprising a memory, which unit is arranged for controlling the tool during the deforming process at least on the basis of deforming curves, the feed rate and/or the rotational speed with which the workpiece and the tool are rotated relative to each other, which parameters are stored in the memory. The forming machine is furthermore provided with at least one detector for measuring values of one or more coordinates of the position of the extreme edge of the workpiece.

BRIEF DESCRIPTION OF THE DRAWINGS

The invention will now be explained in more detail with reference to the figures, which show various embodiments of the invention.

Identical parts and parts that perform the same or substantially the same function are indicated by the same numerals in the figures.

DETAILED DESCRIPTION OF THE ILLUSTRATIVE EMBODIMENTS

Figure 1:
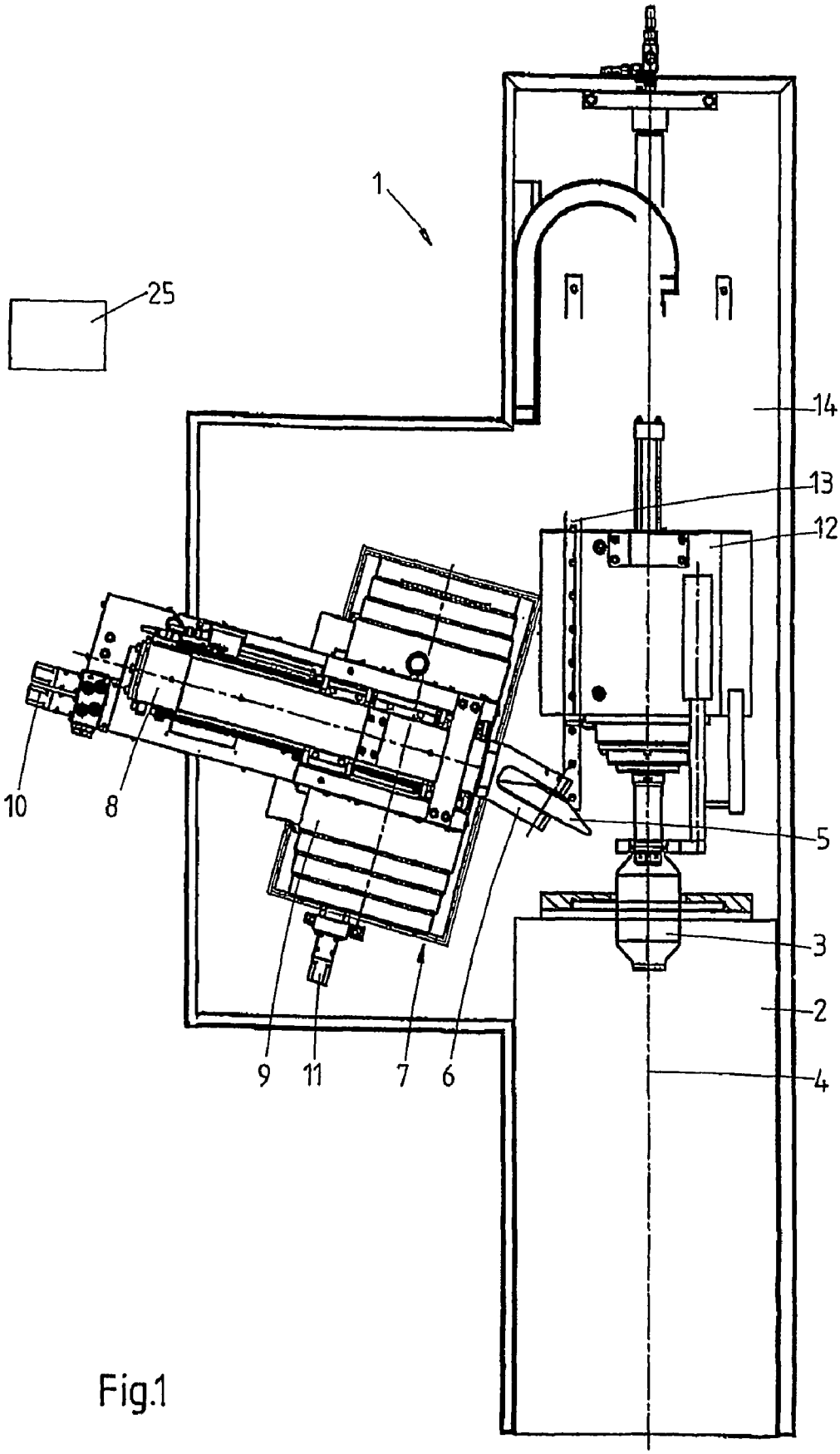
FIG. 1 is a top plan view of a first forming machine according to the present invention, which is provided with a detector.
Figure 2:
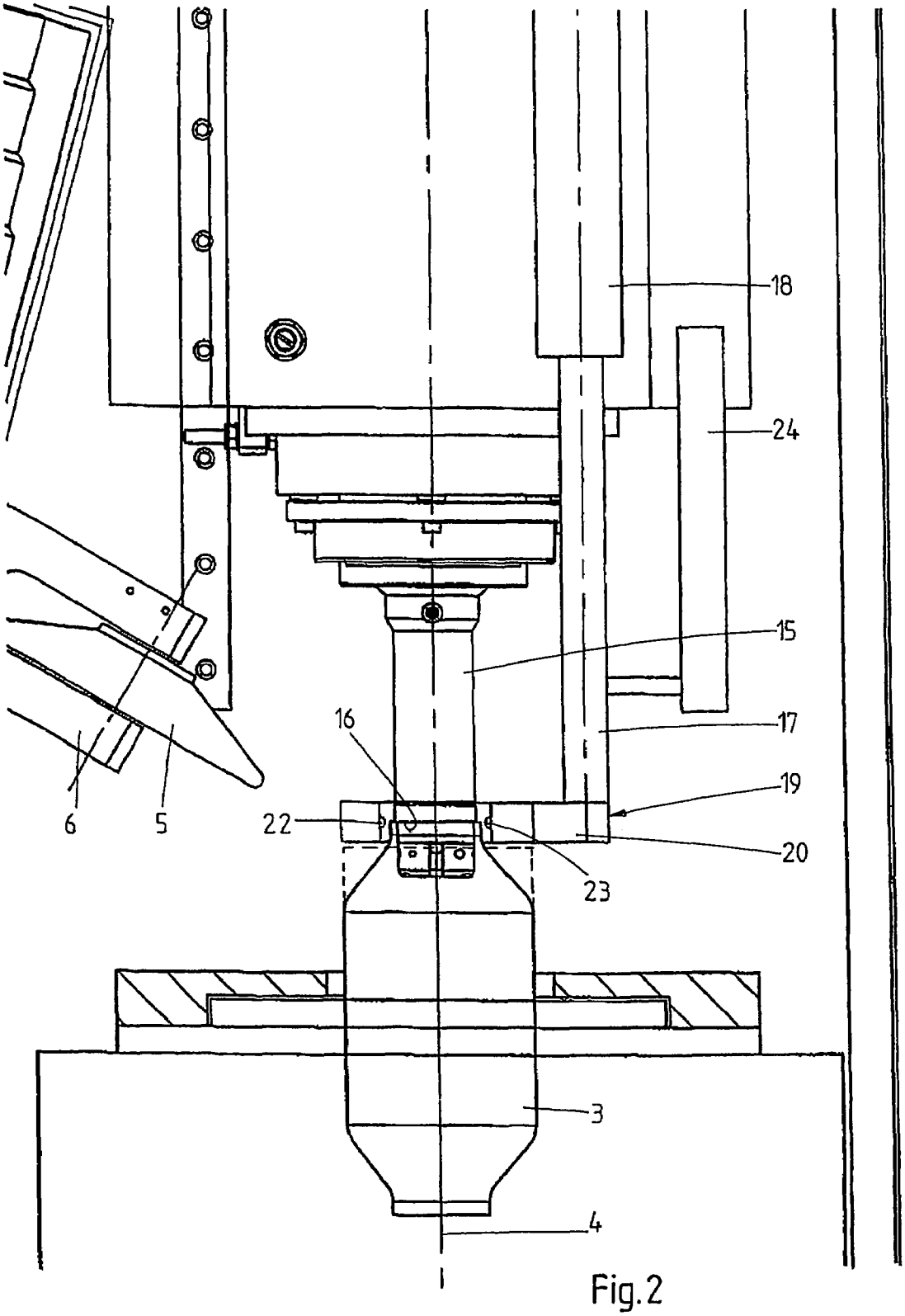
FIG. 2 shows a detail of the top plan view of FIG. 1.

FIGS. 1 and 2 show in schematic top plan view a first embodiment of a forming machine 1 for deforming metal cylinders, which machine 1 comprises a rotatably drivable clamping device 2, in which one end of a metal workpiece 3 is clamped down in a known manner and by means of which said workpiece 3 can be rotated about an axis of rotation 4. In this figure, the workpiece 3 is shown in its original form of a circular cylinder (dotted lines), and in the intended form (full line).

The workpiece 3 can be deformed by means of a forming roller 5, which is rotatably mounted in a holder 6. To that end, the forming roller 5 must follow a specific path of movement comprising one or more deforming curves, the holder 6 being attached to a slide group 7, which may be configured as described in the aforesaid European application No. 0 125 720, whose content is considered to be incorporated herein by reference. The slide group 7 comprises an upper slide 8, on which the holder 6 is mounted, which upper slide is mounted on an upper bed in such a manner as to be capable of reciprocating movement in a first direction. Said upper bed is connected to a lower slide 9, which is mounted on a lower bed in such a manner as to be capable of reciprocating movement in a second direction perpendicular (in this example) to said first direction. The upper slide 8 and the lower slide 9 are each provided with driving means 10, 11, such as a pneumatic or hydraulic cylinder, a servo motor or the like.

Positioned opposite the workpiece 3 is a tailstock 12, which is known per se, which head is mounted on the same machine bed 14 as the clamping device 2 and the slide group 7, capable of reciprocating movement on rails 13. The tailstock 12 is provided with a mandrel 15, whose (imaginary) central axis coincides with the axis of rotation 4 of the clamping device, which mandrel is provided with a annular stop shoulder 16 positioned a few centimetres from the end of said mandrel. Furthermore, a detector 19 is connected to the tailstock 12 via a rod 17 and driving means 18, such as a pneumatic or hydraulic cylinder, a servo motor or the like (note: the detector 19 is the only part that is shown in side elevation). In this embodiment, the detector 19 comprises a U-shaped element 20 at the end of the rod 17, the spacing between the legs thereof preferably being larger than the external diameter of the workpiece 3 that is to be deformed. A laser diode 22 and a laser sensor 23 may be connected to respective ends of said legs. In the activated condition of the laser 22, the laser beam will be positioned to the right or to the left of the mandrel 15, in such a manner that said beam is not interrupted by the mandrel 15. The detector 19 can be reciprocated by the driving means 18 in a direction parallel to the axis of rotation 4 of the clamping device 2. The rod 17 is furthermore connected to a known linear position sensor 24, for example a linear encoder, which is fixedly connected to the tailstock 12.

The clamping device 2, the driving means 10, 11, 18, the detector 19 and the linear position sensor 24 are connected to a control unit 25 (schematically indicated) in a known manner. Stored in said unit 25 are inter alia the deforming curves to be followed by the forming roller 5, the feed rates and the rotational speed of the clamping device 2.

In this example, a cylindrical workpiece 3 is deformed into a housing, e.g. for a catalytic converter substrate for use in an exhaust system for an internal combustion engine. The deforming curves to be followed by the forming roller 5, the feed rates and the rotational speed of the clamping device 2 have preferably been obtained during a teach-in phase as described in the aforesaid EP 0 125 720, in order that said parameters are precisely geared to a specific workpiece and a specific product.

The method according to the invention can be carried out as follows by means of the forming machine as described herein and as shown in the figures:

The values as determined for a specific combination of a workpiece 3 and a product (deforming curves, feed rates and rotational speed, among other things) are loaded into the control unit 25. The workpiece 3 is clamped down in the clamping device 2. The detector 19 is moved in the direction of the workpiece 3, until the laser beam is interrupted by said workpiece 3. The detector is then moved back to a position just before the interrupting position. The position of the extreme edge of the workpiece 3 is thus determined, in this case as a function of a coordinate on the axis of rotation 4 of the clamping device 2, and input into the control unit 25. Subsequently, the rotating workpiece 3 is deformed according to a first deforming curve during a first pass. During the deforming process, the detector 19 continues to follow the extreme edge and communicate the position of said edge to the control unit 25. The control unit 25 then determines whether the position of said edge corresponds to the stored (expected) position or whether it is leading in advance of or lagging behind said position.

As long as the actual position falls within the tolerance of the stored position, the programmed values are not interfered with.

If the actual position is leading by too much, and there is a risk of the deformed part of the workpiece becoming too long, the feed rate is increased and/or the rotational speed is decreased, or one or more of the deforming curves is/are shifted inwardly, i.e. in the direction of the axis of rotation 4, or their shape is changed without locally reduced portions being created. It stands to reason that it is also possible to use combinations of said magnitudes, and the control unit may be so arranged that the feed rate is changed first, for example, and that one or more deforming curves is/are subsequently shifted inwardly if a specific threshold value is exceeded.

If there is a risk of the deformed portion becoming too short, the feed rate is decreased and/or the rotational speed is increased, or one or more of the deforming curves is/are shifted outwardly, i.e. in a direction away from the axis of rotation 4.

In cases in which not only the diameter of the extreme edge and the length of the deformed portion of the finished product are specified, but also the changes in the shape of the wall of the deformed portion, for example, the feed rate, the rotational speed and the force exerted on the workpiece by the forming roller (for parts present on a forming tool) can be successively adapted, for example, whilst leaving the deforming curves unchanged.

Figure 3:
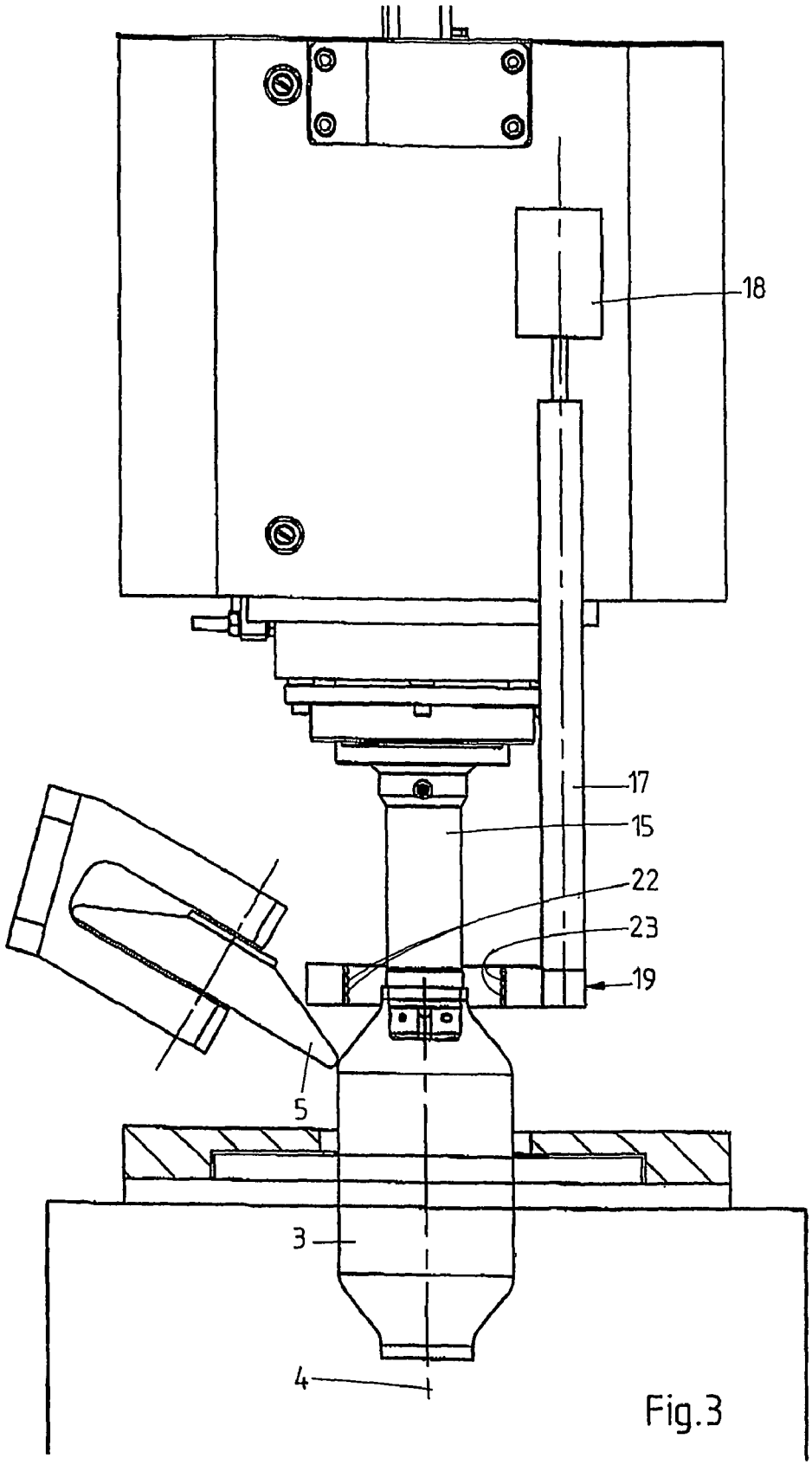
FIGS. 3-5 show the same detail of FIG. 1, each with a different detector, however.
Figure 4:
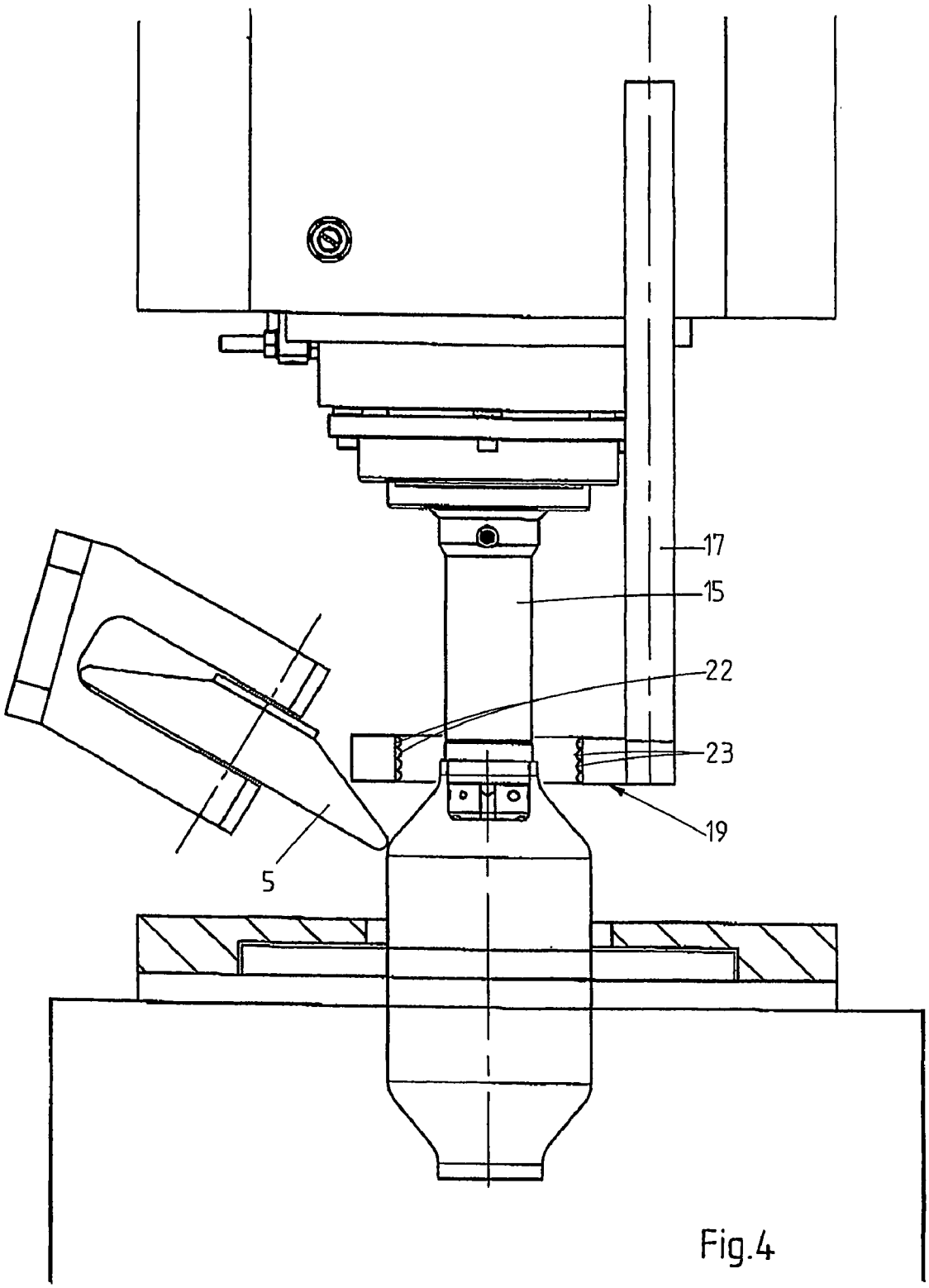
Figure 5:
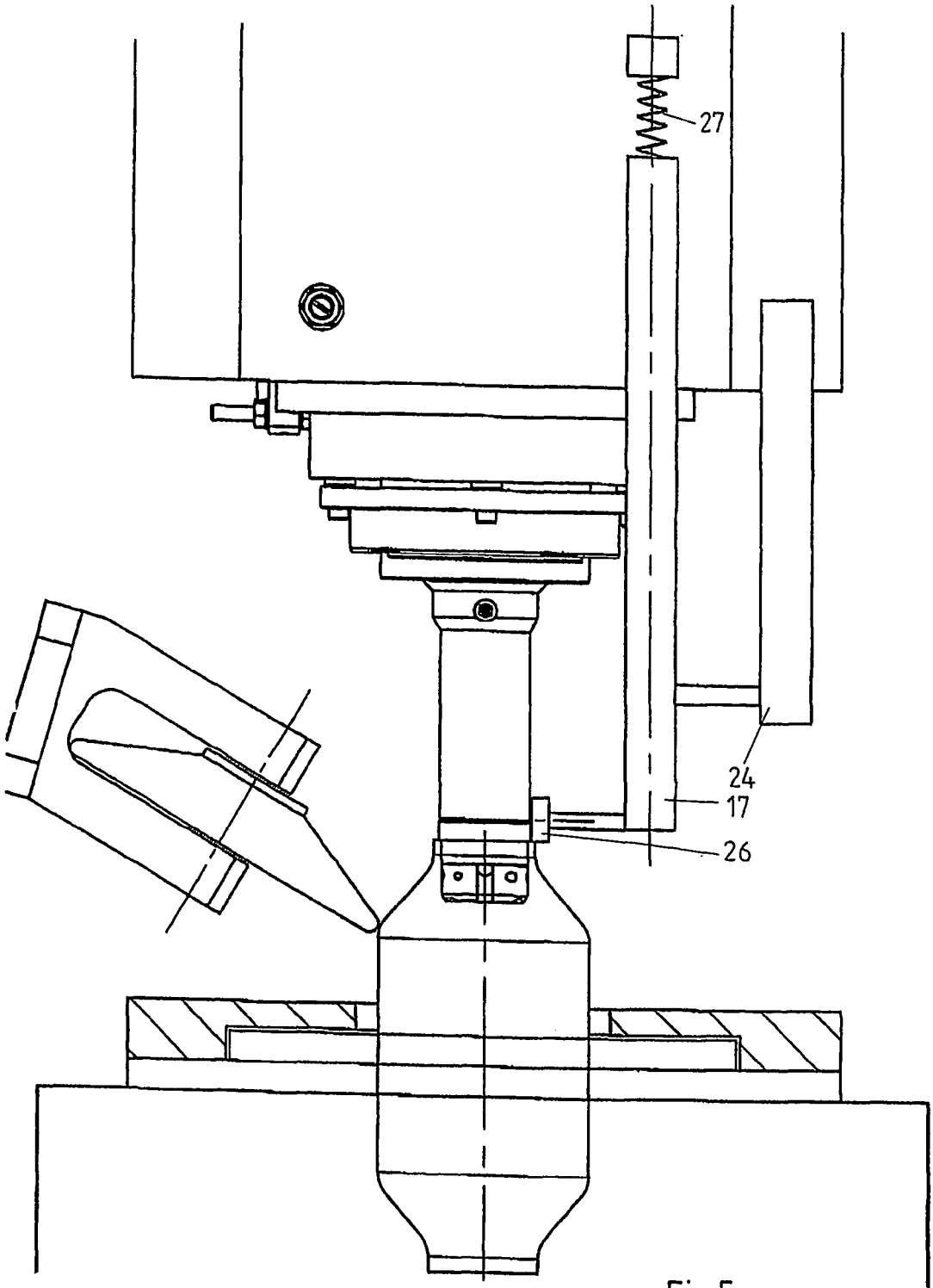

During the final pass, the end of the workpiece is deformed on the mandrel and against the annular stop shoulder, so that the internal diameter and the length of the obtained extreme edge of the semi-manufactured product are precisely defined FIGS. 3-5 show variants of the detector 19. In FIG. 3, the forming machine is equipped with a detector that is provided with a series of a laser diodes and a series of corresponding laser sensors positioned opposite thereto. In that case the position of the extreme edge of the workpiece can be determined on the basis of the number of laser beams that are interrupted by said edge. This enables a simplification of the control loop according to which the detector 19 scans the extreme edge of the workpiece or, if the series is sufficiently long, said control loop may even be left out altogether (FIG. 4). In that case sufficient sensors will be present for following the position of the extreme edge without moving the detector.

Besides carrying out contactless measurements, it is also possible to scan the extreme edge of the workpiece by means of a detector, one or more parts of which, e.g. a bearing 26 which is urged into contact with said edge with a suitable force by means of a spring 27 (FIG. 5).

Figure 6:
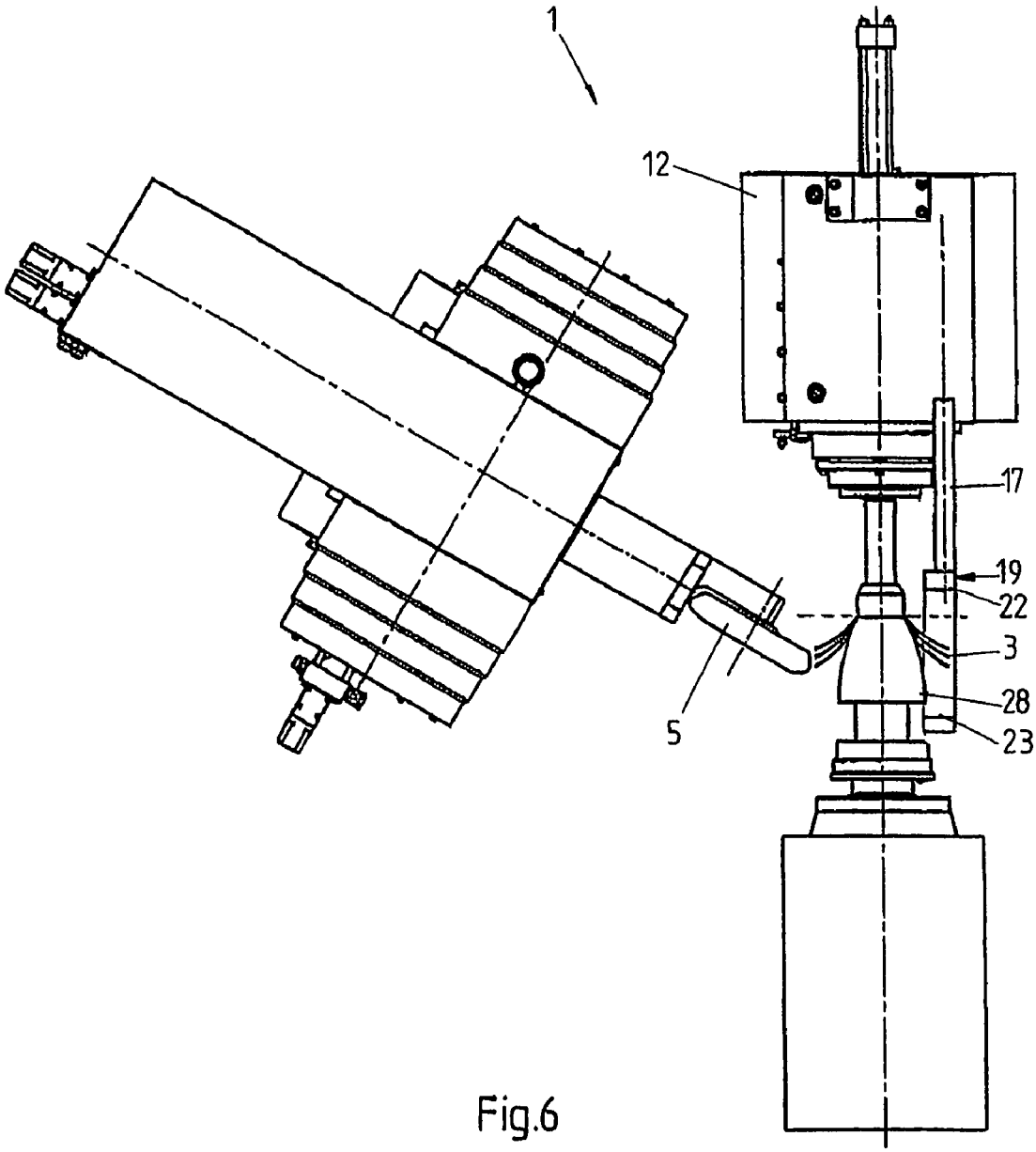
FIG. 6 is a top plan view of a second forming machine according to the present invention, which is provided with a detector.
Figure 7:
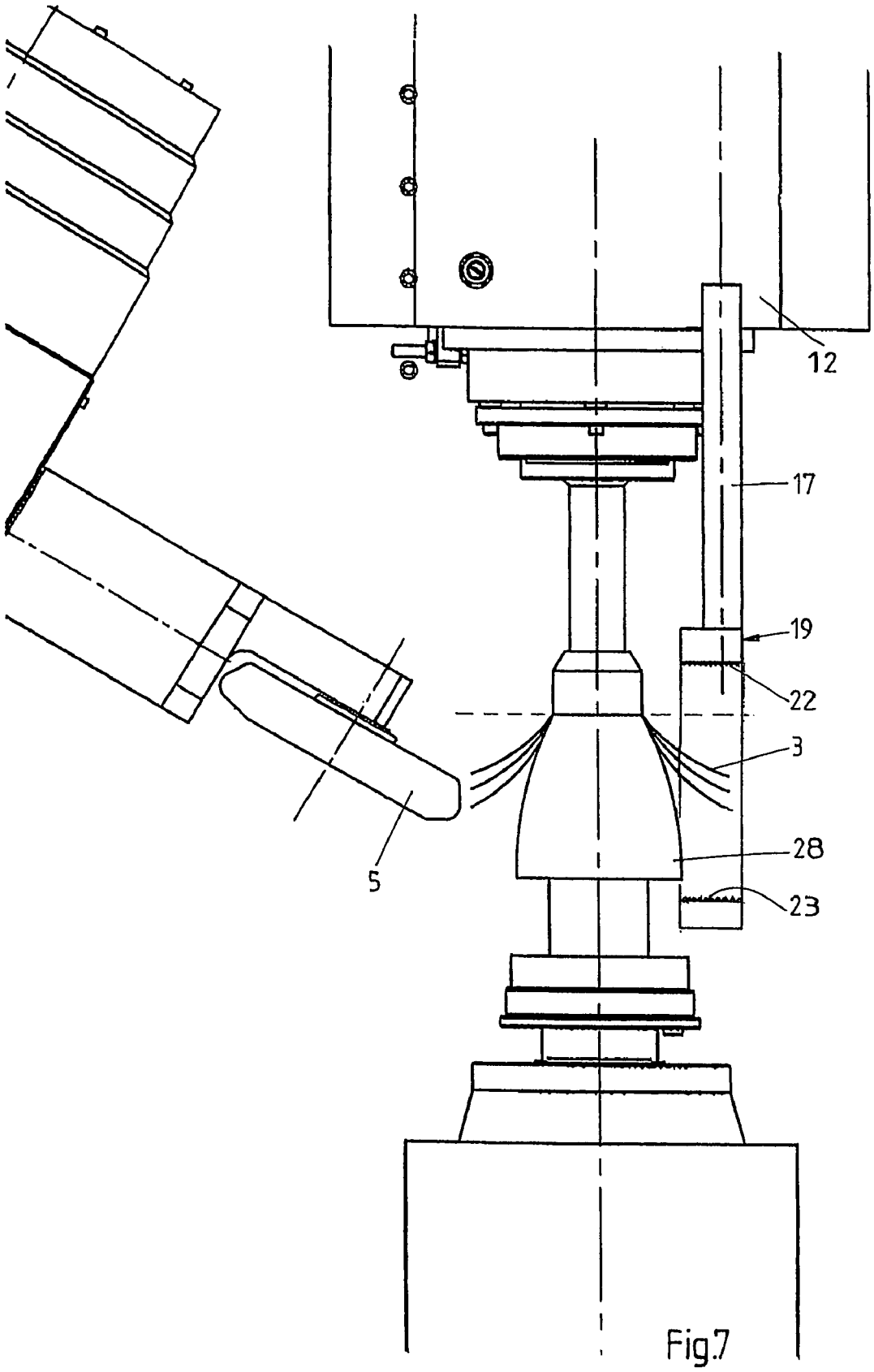
FIG. 7 shows a detail of the top plan view of FIG. 1.

FIGS. 6 and 7 are schematic top plan views of a second embodiment of the forming machine 1, in this case used for deforming a metal, disc-shaped plate 3. The machine 1 largely corresponds to the machine that is shown in FIG. 1, but in this case the machine comprises a spindle 28, which is clamped down in the rotatably drivable clamping device and which determines the shape of the inner wall of the final product. The plate 3 is clamped against the spindle 28 by means of a tailstock 12 in a known manner, and can be deformed into a desired product, such as a lamp a reflector, and the expansion vessel or the like, by means of a forming roller 5 in a number of passes (the result of a number of said passes is illustrated in full lines).

A detector 19 is connected to the tailstock 12 via a rod 17. In this embodiment, the detector 19 comprises two series of laser diodes 22 and sensors 23 disposed opposite each other. The laser beams extend parallel to the axis of rotation 4, in such a manner that the spacing between said beams and said axis 4 increases in radial direction. The sensors 23 measure which laser beams are interrupted by the edge of the workpiece 3. The position of the extreme edge of the workpiece 3 can then be determined on the basis of the number of laser beams that are interrupted by said edge.

It is also possible to use other detectors than the lasers and sensors that have been described above, of course, such as one or more fibre electrical sensors, cameras (e.g. CCD or CMOS), or other optical measuring systems. Preferably, said systems are adjustable, so that the detector can be adapted to a specific workpiece and/or product.

It stands to reason that the invention is not limited to the embodiment as described above, which can be varied in many ways within the scope of the invention as defined in the claims. Thus, the invention can also be carried out by using a static workpiece and a rotating tool, or a rotating workpiece and a rotating tool, as described in International application WO 02/062500, for example. Furthermore it is for example possible to use the invention for eccentrically or obliquely deforming workpieces.

The invention claimed is:

1. A method for deforming a workpiece by a tool having one or more forming rollers, the method comprising:

rotating the workpiece and/or the tool about an axis relative to each other;

moving the tool relative to the workpiece through one or more deforming curves wherein at least part of the workpiece is deformed;

measuring values of one or more coordinates of a position of an extreme edge of the workpiece during the deforming process; and changing a position and/or a shape of one or more of the deforming curves being passed through during the deforming process, a feeding rate and/or a rotational speed with which the tool and the workpiece are rotated relative to each other on the basis of said measurement or measurements, with the proviso that, if the shape of one or more of the deforming curves is changed, no locally reduced portions will be imposed on the deformed portion.

2. The method according to claim 1, wherein measuring values includes measuring said values in a contactless manner.

3. The method according to claim 1, wherein measuring values includes measuring the values of one or more coordinates of the position of the extreme edge of the workpiece at least at the end of each pass.

4. The method according to claim 3 wherein changing one or more parameters of the deforming process includes continuously adjusting at least one of the parameters of the deforming process continuously on the basis of the measured values.

5. The method according to claim 1, wherein at least the extreme edge of the workpiece is deformed on a forming tool.

6. A forming machine for deforming a workpiece, comprising:

a forming tool, one or more drives configured to move said tool, a control unit comprising a memory, wherein the control unit is arranged for controlling the tool during the deforming process at least on the basis of deforming curves, the feed rate and/or the rotational speed with which the workpiece and the tool are rotated relative to each other, which parameters are stored in the memory, at least one detector configured to measure values of one or more coordinates of a position of an extreme edge of the workpiece and provide said measured values to the control unit, and wherein the control unit is arranged for changing the position and/or the shape of one or more of the deforming curves being passed through during the deforming process, the feeding rate and/or the rotational speed with which the tool and the workpiece are rotated relative to each other on the basis of the measurement or measurements obtained by said at least one detector, with the proviso that, if the shape of one or more of the deforming curves is changed, no locally reduced portions will be imposed on the deformed portion.

7. The forming machine according to claim 6, wherein said at least one detector comprises a series of sensors.

8. The forming machine according to claim 6 wherein said forming tool, is a mandrel configured such that, at least the extreme edge of the workpiece is deformed.

9. The forming machine according to claim 8, wherein the forming tool is provided with a stop configured to determine a length of at least a portion of the workpiece.

* * * * *